US010322558B2

(12) United States Patent
Brokate et al.

(10) Patent No.: US 10,322,558 B2
(45) Date of Patent: Jun. 18, 2019

(54) DEVICE AND METHOD FOR ERECTING PREDOMINANTLY PLANE MATERIAL BLANKS

(71) Applicant: Kolbus GmbH & Co. KG, Rahden (DE)

(72) Inventors: Nils Brokate, Bahrenborstel (DE); Heiko Landwehr, Barnstorf (DE); Klaus Gerke, Bassum (DE)

(73) Assignee: Kolbus GmbH & Co. KG, Rahden (DE)

( * ) Notice: Subject to any disclaimer, the term of this patent is extended or adjusted under 35 U.S.C. 154(b) by 529 days.

(21) Appl. No.: 14/870,746

(22) Filed: Sep. 30, 2015

(65) Prior Publication Data

US 2016/0096338 A1 Apr. 7, 2016

(30) Foreign Application Priority Data

Oct. 7, 2014 (DE) ..... 10 2014 014 939

(51) Int. Cl.
*B31B 50/26* (2017.01)
*B31B 50/02* (2017.01)
(Continued)

(52) U.S. Cl.
CPC ..... *B31B 50/00* (2017.08); *B31B 50/02* (2017.08); *B31B 50/26* (2017.08); *B31B 50/46* (2017.08);
(Continued)

(58) Field of Classification Search
None
See application file for complete search history.

(56) References Cited

U.S. PATENT DOCUMENTS 2,826,127 A * 3/1958 Straw ..... B31B 50/00 271/144
3,010,639 A * 11/1961 Govatsos ..... B31B 50/00 229/198.2
(Continued)

FOREIGN PATENT DOCUMENTS

CN 2330502 Y 7/1999
CN 103786368 A 5/2014
(Continued)

OTHER PUBLICATIONS

European Search Report dated Jan. 29, 2016 for European Patent Application No. 15002329.9.

*Primary Examiner* — Hemant Desai
*Assistant Examiner* — Tanzim Imam
(74) *Attorney, Agent, or Firm* — Alix, Yale & Ristas, LLP

(57) ABSTRACT

The invention pertains to a device and a method for producing hollow bodies that are open on one side of predominantly plane material blanks by erecting and gluing their sides along prepared bending edges, wherein said device features a shaft that is arranged directly downstream of the erecting elements and accommodates the hollow bodies in order to cure the glued joints, and wherein the products are spaced apart from one another during their transport within the shaft. The transport device provided for this purpose preferably acts directly upon the glued edges or areas located adjacent thereto such that the glued joint is continuously stabilized during the curing process.

20 Claims, 2 Drawing Sheets

(51) Int. Cl.

| | |
|---|---|
| ***B31B 50/00*** | (2017.01) |
| *B31B 50/46* | (2017.01) |
| *B31B 100/00* | (2017.01) |
| *B31B 50/62* | (2017.01) |
| *B31B 110/35* | (2017.01) |

(52) U.S. Cl.
CPC ..... *B31B 50/626* (2017.08); *B31B 2100/00* (2017.08); *B31B 2100/0024* (2017.08); *B31B 2110/35* (2017.08)

(56) References Cited

U.S. PATENT DOCUMENTS

| | | | | |
|---|---|---|---|---|
| 3,056,337 | A | | 10/1962 | Bahr et al. |
| 3,146,565 | A | * | 9/1964 | Otto ..... B65B 1/02 493/309 |

FOREIGN PATENT DOCUMENTS

| | | | |
|---|---|---|---|
| DE | 480726 | | 7/1929 |
| DE | 519493 | | 2/1931 |
| DE | 521084 | | 3/1931 |
| DE | 10118390 | A1 | 10/2002 |
| DE | 602005003875 | T2 | 12/2008 |
| FR | 2706355 | A1 | 12/1994 |
| GB | 989088 | | 4/1965 |

* cited by examiner

DEVICE AND METHOD FOR ERECTING PREDOMINANTLY PLANE MATERIAL BLANKS

BACKGROUND

The present invention pertains to a device for erecting predominantly plane material blanks along prepared bending edges.

CN 2 330 502 Y discloses a device for producing boxes of punched blanks. This device comprises a magazine with a separating device for storing the plane punched blanks, a device with application nozzles for applying glue, a forming device for erecting a punched blank with glue applied thereon into a box, as well as transport devices for transferring the blanks between the aforementioned processing stations. The forming device comprises funnel-shaped guide elements for erecting the box, wherein these guide elements initially take hold of areas of the initially plane blank to be erected and then erect these areas relative to the base of the blank opposite to its transport direction.

The disclosed device furthermore comprises pivotable elements for folding over areas of the blank that are not taken hold of by the funnel-shaped guide elements such as, e.g., glue tabs.

A pressing device is arranged downstream of the erecting device and respectively accommodates one individual erected box in order to apply pressure upon its glued surfaces from outside by means of movable elements. The inner countersupport is formed by a plunger that pushes the blank into the pressing device through the erecting device with the described funnel-shaped guide elements.

During the transfer of the box from the erecting device to the spaced-apart pressing device, the box is only held on its inner side by the plunger with the aid of a suction element such that the glued joints may once again separate. This may lead to the glued surfaces no longer being aligned relative to one another such that the quality of the finished boxes is compromised. In addition, the box with the erected surfaces is moved in a sliding fashion on stationary elements such that markings are produced on the outer surfaces of the boxes due to the restoring forces acting in the bending edges.

In addition to these disadvantages that compromise the quality, the output of the proposed device is also very limited because the erection of a trailing blank can only take place once the glued joints of the leading box have cured to such a degree that the adhesive forces reliably exceed the restoring forces and the glued joints of the box can no longer separate during its removal from the pressing device. Only then can the plunger return into its home position and take hold of the next material blank during an ensuing work stroke.

CN 103 786 368 A discloses a device for producing boxes that are open on one side of plane material blanks by erecting the side areas. This device comprises a stationary annular die and a movable plunger that presses the plane material blank into the die. The forming inner contour of the die continues in a directly adjacent shaft that is composed of four stationary walls and receives already erected boxes. A first box located in the die is pushed forward in the shaft by a second box during the forming process thereof. This process is repeated such that the shaft is filled with a stack of boxes. The shaft is divided into two zones, wherein a first zone located adjacent to the die can be heated and a second zone can be cooled.

Although the boxes have a tendency to open due to the tensions introduced into the material blank by the forming process, they are prevented from opening in the shaft by the walls thereof. Since the shaft can simultaneously accommodate several boxes, the time available for stabilizing the desired shape of each box is at the same output multiplied in accordance with the capacity of the shaft. The stabilization of the box shape is additionally accelerated due to the purposeful temperature management in the transport direction.

The boxes push one another forward within the shaft against the friction on the shaft walls. This may lead to the boxes being glued to one another at certain locations such that they can no longer be separated from one another without being damaged. The significant friction between the boxes and the shaft walls caused by the tensions in the boxes leads to markings and damages of the boxes, particularly if the consist of sensitive materials.

The fact that a box remains in the shaft that stabilizes its shape until it is ejected by the trailing boxes results in the shaft always being filled with boxes such that the operating personnel must elaborately clear the shaft of boxes manually, e.g., prior to set-up processes.

SUMMARY

According to the present disclosure, the foregoing disadvantaged are overcome whereby stretched-out material blanks with prepared bending edges and glued surfaces to be joined are individually supplied to the erecting device. Each material blank is guided past erecting elements of the device in such a way that its areas that form sidewalls are erected relative to a bottom area and the material blank is folded into a hollow body that is open on one side. For this purpose, the device features a first transport device that takes hold of the supplied material blank and transports this material blank along the erecting elements of the device against the forces generated by the erection, as well as into a shaft of the device arranged directly downstream of these erecting elements. This first transport device is advantageously realized in the form of a plunger that acts upon the bottom area of the respective material blank or hollow body.

The inner cross section of the shaft corresponds to the outside dimensions of the hollow bodies such that elements of the shaft hold the edges of the hollow body, which were closed due to the erection, in the closed position. The shape of the hollow body is thereby maintained as long as it is located in the shaft. This shaft has such a length that it can accommodate several successively arranged hollow bodies with the same bottom area such that the residence time of each hollow body in the shaft is correspondingly extended. This means that the time period, during which the glued surfaces are stabilized in order to reliably prevent shifting of the glued surfaces relative to one another or even a separation of the glued joints, is also extended. This curing time, during which the glued joints are protected from stresses, results from the output of the device and the length of the shaft.

The shaft comprises at least one additional transport device that ensures the advance of the hollow bodies accommodated within the shaft in the longitudinal direction thereof, wherein the hollow bodies are always spaced apart from one another. In this way, the hollow bodies are also prevented from being unintentionally glued to one another if glue residues ooze out of the joints and the shaft can be easily cleared of hollow bodies.

It is preferred that at least one transport element of the transport device takes hold of at least one of the edges glued due to the erection or at least one of the surfaces located adjacent to these edges in such a way that the transport element effectively transports the hollow body and even holds the edges closed at the corners. In this way, the shaft with its at least one transport device can be constructed in a very compact and simple fashion and relative motions between the glued edge and the element holding this edge closed, as well as damages to the hollow body resulting thereof, are prevented during the advance of the hollow body.

In an advantageous embodiment of the device, each edge of the hollow body glued due to the erection is assigned a transport device with a transport element that holds the respectively assigned edge closed such that all glued edges are analogously fixed for the curing process. Furthermore, all holding forces of the transport devices therefore directly act upon all glued joints in a stabilizing fashion. Stationary guide elements, along which the hollow bodies can slide under friction and the risk of damages, therefore can be eliminated, particularly if the hollow bodies have small dimensions.

It is preferred that each transport element taking hold of the hollow body in the region of confronting edges (i.e., corner region of the hollow body) comprises a groove for accommodating this corer such that a positive fit between the transport element and the accommodated corner is produced and the edges of the corner can be held closed in a particularly simple fashion.

In a preferred embodiment of the device, the transport element is realized in such a way that it not only fulfills the transport function, but also causes the erection of the respective side area taken hold of such that separate erecting elements can be eliminated and a simple and neatly arranged construction of a combined erecting and holding device can be achieved.

In order to achieve a simple design of the transport device acting in the shaft and to easily realize adjustable distances between the hollow bodies in the shaft, the transport device comprises a revolving transport element such as, e.g., a belt. In this case, the deflection radius of the revolving transport element forming the shaft inlet forms the erecting element.

A gentle product transport and variable distances between the hollow bodies due to variable motion profiles are achieved with a controllable drive of the at least one second transport device which is connected to the control of the device.

BRIEF DESCRIPTION OF THE DRAWING

An exemplary embodiment of the inventive method and a device for carrying out this method are described in greater detail below with reference to the figures. In these figures.

DETAILED DISCLOSURE

Figure 1:
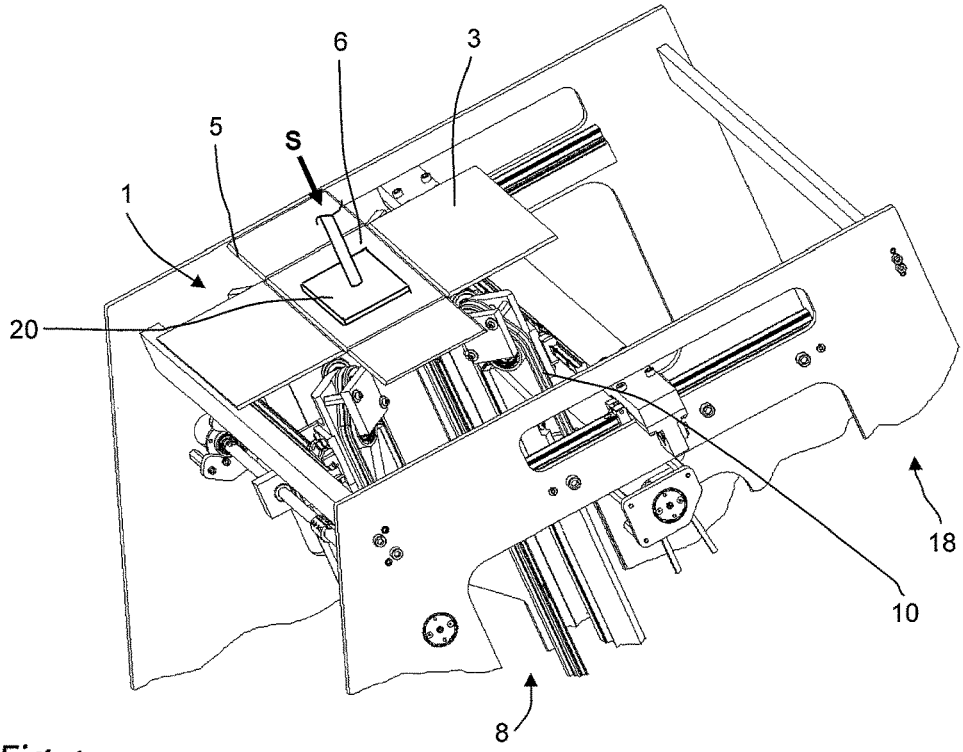
FIG. 1 shows a perspective representation of a detail of an erecting device with a supplied blank.
Figure 2:
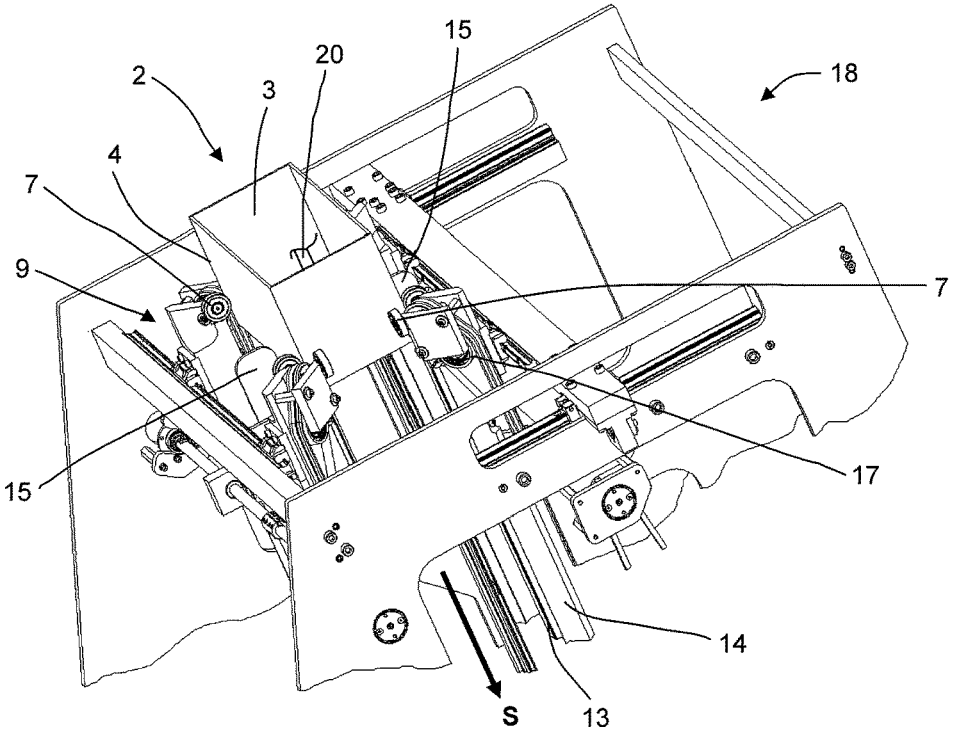
FIG. 2 shows a perspective representation of a detail of an erecting device with an erected hollow body.
Figure 3:
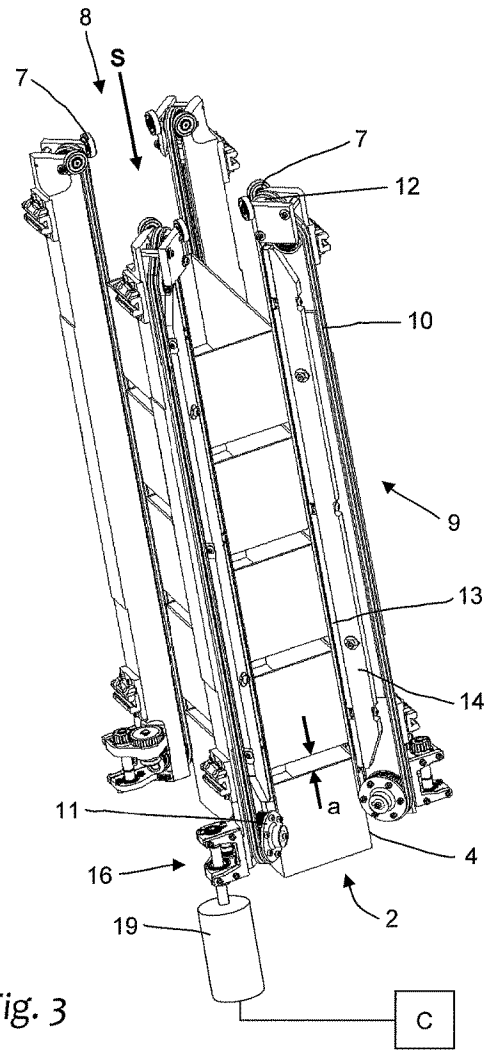
FIG. 3 shows a perspective representation of a shaft accommodating the hollow bodies.

FIGS. 1-3 show a material blank 1 that is prepared for the erection and supplied to the erecting device, and the resulting erected hollow body 2. In this case, the areas of the material blank, which form the bottom or base 6 and the sidewalls 3 of the hollow body 2 to be produced, lie in the same plane above the erecting elements 7. The edge surfaces 5 of each adjacent sidewall to be glued together as a closed corner in a joint region are already provided with glue and the blank is aligned relative to the erecting elements 7.

In addition to the erecting elements 7, the device comprises transport devices 9 that respectively take hold of one corner 4 produced due to the erection of the hollow body 2 and form a shaft 8 that extends in the transport direction S of the hollow bodies and can accommodate several erected hollow bodies 2. The shaft 8 has an infeed end and a discharge end, and is inclined relative to the vertical line in accordance with the transport direction S such that a great length and therefore a large capacity of the shaft 8 can be achieved with a small space requirement and easy access to the shaft, as well as a simple supply of the material blanks 1.

A plunger 20 that starts in a home position at the infeed end of the shaft and acts in the transport direction S inserts the supplied blank illustrated in FIG. 1 into the shaft along dedicated erecting elements 7 to such an extent that the side areas 3 are erected and the thusly produced hollow body 2 is reliably taken hold of by the transport devices 9 of the shaft 8. Subsequently, the plunger completes the stroke by returning in the opposite direction to its home position. Preferably, the erecting elements 7 initiate the lifting of the side areas 3 and the transport device 9 cooperates with the erecting elements to immediately close the edges and fully form the hollow body.

The erecting elements 7 are formed by rolls that are simply supported in a freely rotatable fashion and provided with an elastic surface in order to prevent damages to the respective blank 1 or hollow body 2. These rolls are respectively arranged in pairs, wherein one pair of rolls 7 is assigned to each of the corners 4 to be produced due to the erection in the transport direction S such that two rolls 7, which respectively belong to different pairs, act upon each of the sidewalls 3. According to FIG. 4, the rolls 7 are aligned in such a way that their rotational axis respectively extends parallel to the sidewall 3 to be erected thereby and perpendicular to the transport direction S.

Each of the transport devices 9 comprises a carrier 14 that extends in the transport direction S, wherein a pulley 11 is arranged on the end of the carrier that faces the shaft outlet and a return pulley 12 is arranged on the end of the carrier that faces the shaft inlet. A transport element in the form of a belt 10 is looped around the pulley 11 and the return pulley 12. A tensioning pulley 17 is provided for adjusting the belt tension and is also mounted on the carrier 14. The run of the belt 10 that takes hold of the hollow bodies 2 is supported by a rail 13 such that the belt 10 is guided in the transport direction and can also subject the hollow bodies to a normal force that reliably holds the hollow bodies 2 without excessive tension of the belt 10. This rail 13 is mounted in a spring-loaded fashion relative to the carrier 14 such that the hollow bodies are on the one hand reliably held and on the other hand not damaged even if the transport device 9 is in a slightly incorrect position or the dimensions of the hollow bodies deviate. Pressure that is purposefully exerted upon the glued surfaces in this way can accelerate the curing of the glue in dependence on the material to be glued and the glue used.

Figure 4:
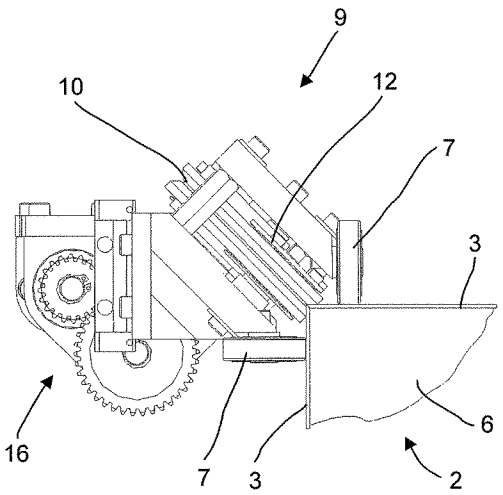
FIG. 4 shows a view of a transport device of the shaft accommodating the hollow bodies in the transport direction.

The transport devices 9 can be respectively displaced in the plane defined by the bottoms 6 of the hollow bodies 2 such that they can be adjusted to different formats of the respective blanks 1 or hollow bodies 2. In this case, the belts 10 are respectively aligned symmetrically to the assigned corner 4 of the hollow bodies 2 as shown in FIG. 4. In order to also hold the freshly glued corner 4 closed against the restoring forces acting in the bending edges in addition to fulfilling the transport function, the belts 10 feature on their carrying side a groove or angled recess with the cross section of, e.g., an equilateral triangle, wherein the aperture angle corresponds to the contour of the corner 4 to be held as shown in FIG. 4. Since the belts therefore have a relatively thick cross section, they feature a corrugation in order to still realize small deflection radii.

FIG. 3 shows how four transport devices 9 of this type form a shaft 8 that accommodates several cuboid hollow bodies 2. Hollow bodies with different geometries can also be produced with a modified arrangement and, if applicable, a different number of transport devices 9. The illustrated distance "a" between the hollow bodies 2 is realized due to the interaction of the motion profiles of the plunger stroke on the one hand and the speed of the belts 10 of the transport devices 9 on the other hand. In order to realize these distances independently of the height of the hollow bodies 2, a controllable drive 19 is provided for the transport devices 9 and connected to the control C of the device. Gear 16 connects the pulley 11 to the drive 19.

Additional guides 15 are provided and respectively arranged centrally between two transport devices 9 in order to prevent an outward curvature of large-format sidewalls 3.

Distinct or dedicated erecting elements 7 are not necessary, because if properly positioned the inlet region of the transport device, i.e., the belts 10 that are looped around the return pulleys 12, can function as integral erection elements to lift the side areas 3 as the belts pull the side areas downward to join the edges. This enables construction of a more compact device.

The motion profiles of plunger 20 and transport device 9 can be varied according to several options.

The home position of the plunger 20 is spaced at a distance to the erecting elements, for feeding the blank. The stroke is parallel to the transport direction of the transport device. As affected by the plunger, the blank passes the erecting elements. Before the plunger arrives at its opposite end position it inserts the blank into the transport device. During handover, when both the plunger and the transport device affect the body at the same time, the speed of the plunger does not need to be the same as the speed of the transport element. The plunger may be slower, whereby the transport device pulls the body, or it may be faster, whereby the plunger presses the body into the transport device. But to avoid damage synchronous speed of plunger and transport element during the handover is advantageous.

The speed of the transport is a function of the height of the fully erected bodies, of the required distance "a" between two following bodies and of the motion profile of the plunger (and vice versa). The body does not need to be fully erected when inserted into the transport device. The body may be fully erected already before affected by the transport device. In a preference the erecting elements initiate the lifting and then erecting elements and transport elements cooperate for realizing a compact design. In an extremum this leads to the embodiment without additional erecting elements, wherein the transport element itself forms the erecting element.

It should be appreciated that the plunger, piston, pushrod or the like provides a first transport means that urges the planar blanks into the upper end of the shaft. Second transport means such as but not limited to the belts and equivalents, with or without dedicated erection elements, extend along the shaft from the infeed to the discharge, for lifting the side areas of the hollow bodies whereby free edges of adjacent side areas are brought into confronting relationship in a corner region to form the hollow bodies and for transporting the hollow bodies in the shaft along a longitudinal direction through the shaft to the discharge end of the shaft.

The invention claimed is:

1. A device for erecting planar material blanks along prepared bending edges of side areas of the blanks into hollow bodies that have outer dimensions and an open top, the device comprising:

a shaft extending in a longitudinal direction with a length in the longitudinal direction configured to accommodate several successively arranged erected hollow bodies, wherein the shaft has an inner cross section corresponding to the outer dimensions of each of the several hollow bodies, and wherein the inner cross section includes a plurality of inner corners;

a first transport device that guides each of the material blanks and introduces these material blanks into the shaft; and at least one second transport device including at least one transport element comprising a cooperative pair of rolls positioned at each of the inner corners of the shaft and directed into the inner cross section of the shaft such that one of the pairs of rolls takes hold of each joining region of each of the hollow bodies and transports each of the hollow bodies located in the shaft in the longitudinal direction through the shaft, wherein two of the rolls respectively belonging to two different pairs of the cooperative pairs of rolls act upon each sidewall of each of the hollow bodies during erection of each of the hollow bodies.

2. The device according to claim 1, wherein the at least one transport element of the at least one second transport device comprises a longitudinally extending groove for accommodating one joining region of each of the hollow bodies.

3. The device according to claim 1, wherein the at least one second transport device is respectively assigned to each sidewall of each of the hollow bodies.

4. The device according to claim 1, wherein the at least one transport element of the at least one second transport device is a revolving transport element.

5. The device according to claim 1, including a transport speed control drive operatively connected to the at least one second transport device to assist in controlling a distance between the hollow bodies.

6. The device according to claim 3, wherein the at least one transport element of the at least one second transport device comprises a groove for accommodating one joining region of each of the hollow bodies.

7. The device of claim 1, wherein the at least one second transport device is positioned at each of said plurality of inner corners of the inner cross section.

8. The device of claim 1, wherein the first transport device comprises a plunger and the at least one second transport device comprises at least one moving belt.

9. The device of claim 8, wherein a distance between the hollow bodies is controllable by varying a motion profile of a stroke of the plunger and a speed of the at least one moving belt.

10. The device of claim 9, comprising a transport speed control drive operatively connected to the at least one moving belt to control the speed of the at least on moving belt.

11. The device of claim 1, a distance between the hollow bodies is controllable by varying a motion profile of the first transport device and a speed of the at least one second transport device.

12. A device for erecting planar material blanks along prepared bending edges of side areas of the blanks into hollow bodies that have outer dimensions and an open top, the device comprising:

a shaft for accommodating several erected hollow bodies, wherein the shaft has:

an inner cross section defined by a plurality of lateral sides, the inner cross section corresponding to the outer dimensions of the hollow bodies and including a plurality of corners between adjacent lateral sides, a longitudinal length configured to accommodate several successively arranged erected hollow bodies, an infeed at an upper end of the longitudinal length of the shaft and a discharge at a lower end of the longitudinal length of the shaft, wherein planar blanks are delivered to the infeed with the side areas of the blanks laterally outside the lateral sides of the shaft and the blanks are formed into hollow bodies within the shaft, and the formed hollow bodies are discharged at the lower end of the shaft;

first transport means that urge the planar blanks into the upper end of the shaft;

second transport means extending from the infeed to the discharge of the shaft and positioned at each of said plurality of corners of the inner cross section, the second transport means having a pair of cooperating rolls directed into the inner cross section at each of said plurality of corners, the second transport means being configured to: lift side areas of the hollow bodies whereby free edges of adjacent side areas are brought into confronting relationship at one of said plurality of corners to form the hollow bodies, and transport each of the hollow bodies in the shaft along a longitudinal direction through the shaft to the lower end of the shaft, wherein two of the rolls respectively belonging to two different pairs of the pairs of cooperating rolls act upon each sidewall of each of the hollow bodies during erection of each of the hollow bodies.

13. The device according to claim 12, wherein the second transport means includes a plurality of transport devices, the shaft is formed by said plurality of transport devices, and each transport device has an upper end defining an infeed end of the shaft and a lower end defining a discharge end of the shaft.

14. The device according to claim 13, wherein one of the transport devices is respectively assigned to each erected side area of each of the hollow bodies; and each transport device includes a transport element that revolves between the upper and lower ends of the transport device.

15. The device according to claim 14, wherein each transport element includes an angled recess for engaging a corner region of each of the hollow bodies;

whereby the transport elements simultaneously engage corner regions of a plurality of transported hollow bodies while the second transport means transports each of the hollow bodies to the discharge of the shaft.

16. The device of claim 12, wherein the second transport means is positioned at each of said plurality of corners of the inner cross section.

17. The device of claim 12, wherein the first transport means comprises a plunger and the second transport means comprises at least one moving belt.

18. The device of claim 17, wherein a distance between the hollow bodies is controllable by varying a motion profile of a stroke of the plunger and a speed of the at least one moving belt.

19. The device of claim 18, comprising a transport speed control drive operatively connected to the at least one moving belt to control the speed of the at least on moving belt.

20. The device of claim 12, wherein a distance between the hollow bodies is controllable by varying a motion profile of the first transport means and a speed of the second transport means.

* * * * *